US006531946B2

(12) United States Patent
Abe et al.

(10) Patent No.: US 6,531,946 B2
(45) Date of Patent: Mar. 11, 2003

(54) LOW NOISE AND LOW LOSS REACTOR

(75) Inventors: Masahiro Abe, Yokohama (JP); Michio Tatsuno, Nagano (JP); Fumio Kitamura, Chino (JP)

(73) Assignee: NKK Corporation, Tokyo (JP)

( * ) Notice: Subject to any disclaimer, the term of this patent is extended or adjusted under 35 U.S.C. 154(b) by 0 days.

(21) Appl. No.: 09/836,380

(22) Filed: Apr. 17, 2001

(65) Prior Publication Data

US 2001/0030594 A1 Oct. 18, 2001

(30) Foreign Application Priority Data

| | | |
|---|---|---|
| Apr. 17, 2000 | (JP) | 2000-114991 |
| Oct. 24, 2000 | (JP) | 2000-324003 |
| Jan. 30, 2001 | (JP) | 2001-022217 |

(51) Int. Cl.[7] ..... H01F 27/24

(52) U.S. Cl. ..... 336/213; 336/234; 336/229; 29/605

(58) Field of Search ..... 336/213, 234, 336/229, 212, 198; 29/605, 609

(56) References Cited

U.S. PATENT DOCUMENTS

| | | | | |
|---|---|---|---|---|
| 3,210,701 A | * | 10/1965 | Fastner et al. | |
| 4,427,462 A | * | 1/1984 | Senno et al. | 148/308 |
| 4,975,672 A | * | 12/1990 | McLyman | 174/DIG. 8 |
| 5,165,162 A | * | 11/1992 | Charles | 29/605 |
| 5,210,930 A | * | 5/1993 | Watabe et al. | 29/609 |
| 5,871,662 A | * | 2/1999 | Van Der Zaag et al. | 252/62.62 |
| 6,407,655 B1 | * | 6/2002 | Kitamura | 336/213 |

FOREIGN PATENT DOCUMENTS

| | | |
|---|---|---|
| EP | 0010427 A1 | 4/1980 |
| EP | 0269347 A2 | 6/1988 |
| EP | 0676776 A1 | 10/1995 |

OTHER PUBLICATIONS

Patent Abstracts of Japan, vol. 016, No. 230 (E–1208), May 27, 1992 and JP 04–043622 A (Matsushita Electric Works Ltd.), Feb. 13, 1992, —English language Abstract only.

Patent Abstracts of Japan, Bol. 1996, No. 2, Feb. 29, 1996 and JP 07–263261 A (TDK Corp.), Oct. 13, 1995, —English language Abstract only.

* cited by examiner

*Primary Examiner*—Elvin Enad
*Assistant Examiner*—Jennifer A. Poker
(74) *Attorney, Agent, or Firm*—Frishauf, Holtz, Goodman & Chick, P.C.

(57) ABSTRACT

A wound and laminated iron core is formed by winding a soft magnetic thin strip into a circular ring shape or elliptical ring shape. A coil is then wound around almost an entire outer periphery of the ring of wound and laminated iron core. A cross sectional shape of the wound and laminated iron core vertical to a peripheral direction of the ring is any one of: (i) a circular shape, (ii) an elliptical shape, (iii) a substantially regular polygon of at least 6 sides, (iv) a shape encircled by a pair of point-symmetrically positioned circular arcs or elliptical arcs with a nearly straight line connecting respective edges of the pair of circular arcs or elliptical arcs on both sides of the pair of circular arcs or elliptical arcs, and (v) a shape of a substantially regular polygon of at least 4 sides whose apexes comprise a circular arc or an elliptical arc. As a result, a reactor is provided which gives less noise and loss than a conventional reactor used in a high frequency wave band, and which is small in size, light in weight, and easy to manufacture.

18 Claims, 18 Drawing Sheets

LOW NOISE AND LOW LOSS REACTOR

BACKGROUND OF THE INVENTION

1. Field of the Invention

The present invention relates to a reactor that is used as an inductance element of an inverter circuit, a converter circuit, and the like.

2. Description of Related Art

Use of a laminated iron core in the magnetic core of a reactor used in a high frequency wave band in an inverter circuit, a converter circuit, and the like can reduce the size of the reactor owing to a high magnetic flux density as compared with the use of other material magnetic cores.

In this type of laminated iron core, eddy current generally increases in the case of a thick laminating material, a small specific resistance of the laminating material, and at high applied frequency waves, thus causing large iron loss. Therefore, the laminating material uses a soft magnetic sheet such as silicon steel sheet having a small thickness and a large specific resistance.

Reactors used in a high frequency wave band conventionally and widely adopt the structure that is illustrated in FIG. 1A (plan view). Coils 2*a* and 2*b* are wound around a laminated iron core 11 that comprises iron cores 11*a* and 11*b* which have a square cross section and which are laminated with soft magnetic sheets 110. Normally, each of the coils 2*a* and 2*b* comprises a rectangular conductor wire 20 wound in an upright orientation. Since the rectangular conductor wire 20 has high rigidity, it cannot be wound in a square pattern along the surface of the laminated iron,core 11. Thus, the rectangular conductor wire 20 is wound in a circular pattern as shown in FIG. 1B (which is a sectional view along line I—I in FIG. 1A).

In recent years, it has been desired to utilize higher frequency wave bands to achieve size reduction and increased power source efficiency. Accordingly, the desire for low noise and low loss (i.e., low iron loss and low conductor loss) in reactors has been increased. The reactors of conventional design, however, face the problems described below:

(1) Since adjacent portions of the rectangular conductor wire 20 touch each other, the series capacitance between adjacent portions of the conductor wire 20 is large. Accordingly, switching noise caused from the leakage of high frequency waves via parasitic capacitor becomes significant. As a result, external noise countermeasures are required.

(2) Since the coils 2*a* and 2*b* are located in a proximity arrangement to minimize the reactor size, the parallel capacitance between the coils 2*a* and 2*b* becomes large. Consequently, resonance current occurs in the coils 2*a* and 2*b* when a square wave current is OFF, which resonance current worsens the switching noise characteristic.

(3) Since the coils 2*a* and 2*b* are located in a proximity arrangement, an insulation material to assure insulation dielectric strength is required.

(4) Since adjacent portions of the rectangular conductor wire 20 touch each other, the proximity effect increases the alternating effective efficiency so as to generate calorific loss on the coils 2*a* and 2*b*.

(5) Since adjacent portions of the rectangular conductor wire 20 touch each other, the contact faces between the coils 2*a*, 2*b* and air are limited to the side faces of the rectangular conductor wire 20 (outer peripheral surface of the coil). In addition, since the coils 2*a* and 2*b* are located in a proximity arrangement, effective heat dissipation cannot be achieved. As a result, the size and the weight of the reactor has to be increased so as to increase the heat releasing surface area, and further an insulator is required, which results in increased material costs.

(6) Since the coils 2*a* and 2*b* are separately wound in a circular pattern along the laminated iron core portions 11*a* and 11*b* having a square cross section, a space exists between the coils 2*a*, 2*b* and the laminated iron core portions 11*a* and 11*b*, which increases the iron loss. A laminated iron core 11 having a square cross section, moreover, has a longer winding length of coil than that of a laminated iron core having a circular cross section of the same cross sectional area. As a result, the conductor resistance (which is equal to direct current resistance+skin effect+proximity effect) in the former type of laminated iron core increases, thus increasing the conductor loss of the reactor. And if the inner diameter of the coils 2*a* and 2*b* is the same, the cross sectional area of a laminated iron core 11 having a square cross section is smaller by about 36% than that of a laminated iron core having a circular cross section. As a result, the magnetic flux density in the former type of laminated iron core increases, thus increasing the iron loss of the reactor. Furthermore, a laminated iron core 11 having a square cross section results in a large space between the coils 2*a*, 2*b* and the laminated iron core portions 11*a* and 11*b*, as described above, so that the prevention of vibration and noise is difficult.

(7) Since the coils 2*a* and 2*b* are formed by winding respective rectangular conductor wires in a straight cylindrical shape, leaked magnetic flux from edges of the coils 2*a* and 2*b* is significant.

(8) A thin insulating film is formed on the surface of the laminating material of the laminated iron core 11 to prevent short circuiting. Since, however, same size soft magnetic sheets 110 are laminated, a burr generated on the cut sections of a soft magnetic sheet 110 contacts a sagging portion of an adjacent soft magnetic sheet 110, which destroys the insulating film to induce a micro-short circuit. As a result, the iron loss is significantly increased particularly in a high frequency wave band. And because burr formation and sagging are inevitably generated during shearing, complete prevention of a micro-short circuit is difficult.

(9) Clamping members to fix the plurality of iron cores 11*a* and 11*b* to each other are required, which results in a large number of assembly working hours. And if the clamping members are made of a conductive metal, an insulation treatment against the coils 2*a* and 2*b* is further required.

(10) A specified direct current convolutional characteristic is obtained by inserting a specified gap material 13 between respective iron cores 11*a* and 11*b*. Therefore, gap clamping members are required.

(11) Since the plurality of iron cores 11*a* and 11*b* are fixed to each other, individual iron cores 11*a* and 11*b* are subjected to electromagnetic vibration of high frequency waves, which likely induces the generation of vibration noise or resonance noise.

(12) Since the iron cores 11*a* and 11*b* are fabricated by laminating soft magnetic sheets 110, the number of work hours for shearing, adhering, and the like significantly increases.

(13) To discard the reactor, the treatment cost is significant because the kinds of materials for disassembling and separating are many.

SUMMARY OF THE INVENTION

An object of the present invention is to provide a reactor which generates low noise and low loss without inducing the above-described problems.

The object is achieved by providing a low noise and low loss reactor which comprises a wound and laminated iron core formed by winding a soft magnetic thin strip into a circular ring shape or elliptical ring shape, and a coil wound around almost an entire outer periphery of the ring of wound and laminated iron core, wherein a cross sectional shape of the wound and laminated iron core vertical to a peripheral direction of the ring is any one of: (i) a circular shape, (ii) an elliptical shape, (iii) a substantially regular polygon of at least 6 sides, (iv) a shape encircled by a pair of point-symmetrically positioned circular arcs or elliptical arcs with a nearly straight line connecting respective edges of the pair of circular arcs or elliptical arcs on both sides of the pair of circular arcs or elliptical arcs, and (v) a shape of a substantially regular polygon of at least 4 sides whose apexes comprise a circular arc or an elliptical arc.

DETAILED DESCRIPTION OF THE INVENTION

The inventors of the present invention studied reactors which generate less noise and less loss, and which actualize easier fabrication than conventional reactors used in a high frequency wave band, focusing on the structure and material of the laminated iron core and coil components.

Thus, the inventors of the present invention found that satisfactory performance is attained with a reactor configuration in which a wound and laminated iron core is formed by winding a soft magnetic thin strip in a circular ring shape or an elliptical ring shape, and then a coil is wound around almost an entire outer periphery of the ring of wound and laminated iron core, wherein a cross sectional shape of the wound and laminated iron core vertical to a peripheral direction of the ring is any one of: (i) a circular shape, (ii) an elliptical shape, (iii) a substantially regular polygon of at least 6 sides, (iv) a shape encircled by a pair of point-symmetrically positioned circular arcs or elliptical arcs with a nearly straight line connecting respective edges of the pair of circular arcs or elliptical arcs on both sides of the pair of circular arcs or elliptical arcs, and (v) a shape of a substantially regular polygon of at least 4 sides whose apexes comprise a circular arc or an elliptical arc.

In particular, when the cross sectional shape of the wound and laminated iron core vertical to the peripheral direction of the ring is circular, the space factor increases by a maximum of approximately 57% and the magnetic flux density decreases by about 36% as compared with conventional reactors, thus effectively reducing the iron loss. In addition, the vibration noise caused from space is effectively suppressed.

The cross sectional shape of this type of wound and laminated iron core does not necessarily have to be exactly one of the above-described shapes, and the effect of the present invention can be attained even if the shape is only close to one of the above-described shapes.

On assembling the iron core by winding and laminating a soft magnetic thin strip, the thickness of an insulating film is kept to be very thin to prevent reduction in space factor. The thin insulating film is, however, likely to be damaged by a cut burr generated on edge portions of stacked soft magnetic thin strip, thus likely a generating micro-short circuit. To prevent the occurrence of such a micro-short circuit, it is necessary for the edge portions of the stacked strip to be shifted in position from each other as much as possible. To do this, it is effective that the straight line section or a majority portion thereof forming the outer periphery of the cross section vertical to the peripheral direction of the ring of wound and laminated iron core is not in parallel with a centerline drawn passing through the center in the width direction of the laminated soft magnetic thin strip along the laminating direction.

Figure 2A:
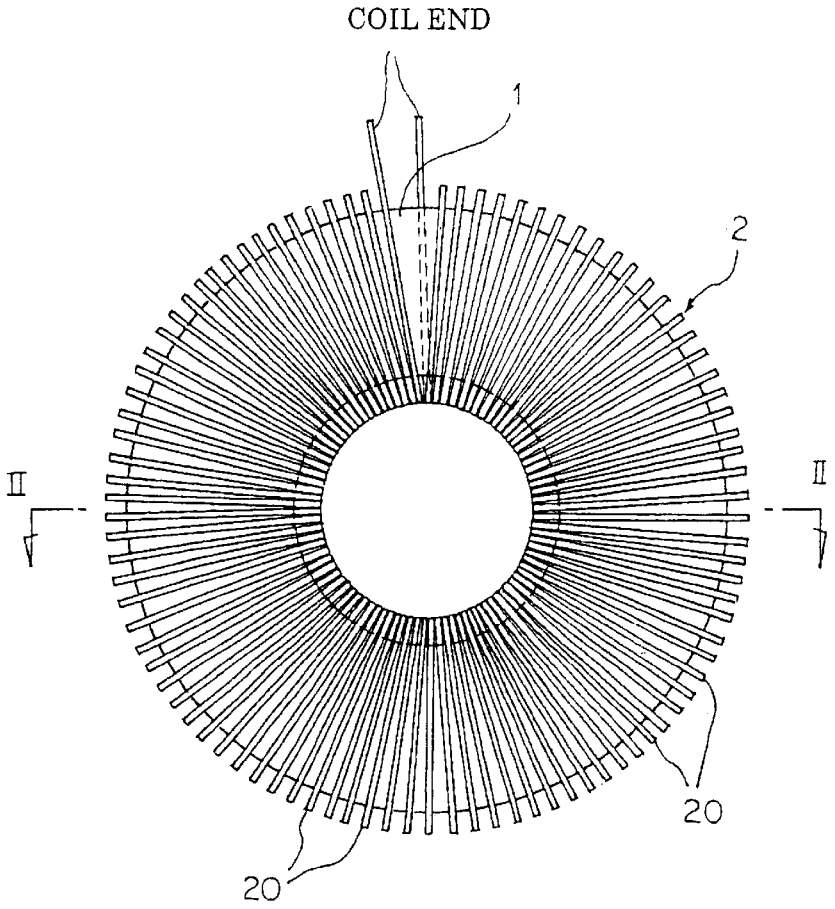
FIG. 2A and FIG. 2B show an example of a reactor according to the present invention.
Figure 2B:
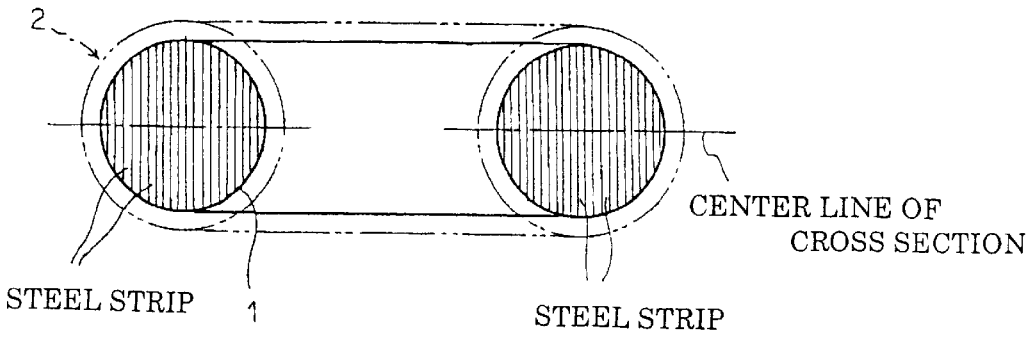
Figure 3:
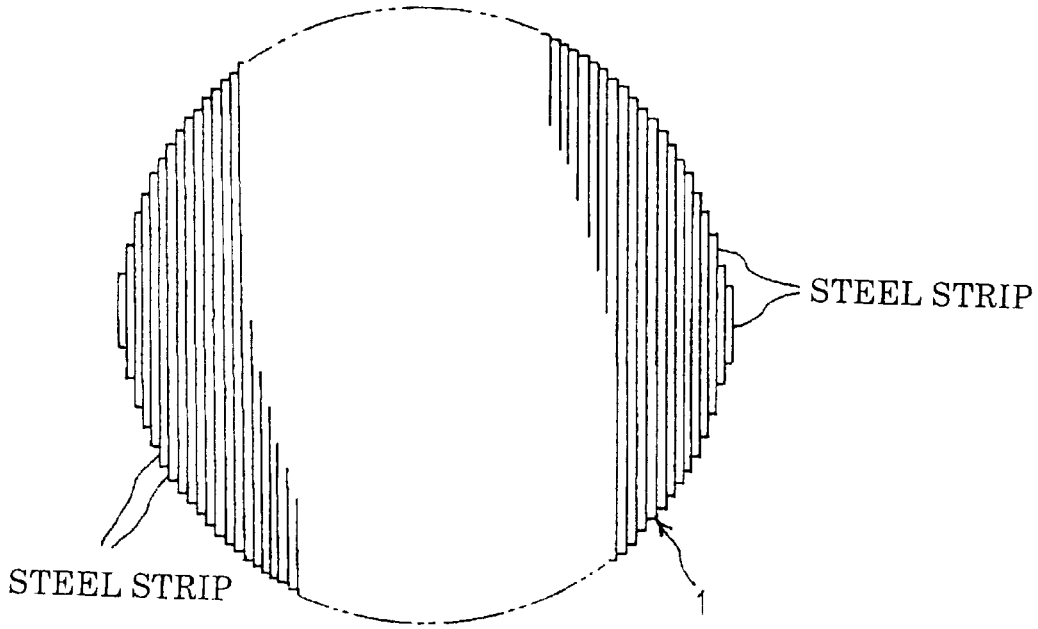
FIG. 3 is the wound and laminated iron core of FIG. 2 viewed from above the circular ring periphery.

FIG. 2A (which is a plan view), FIG. 2B (which is a sectional view along line II—II of FIG. 2A), and FIG. 3 show an example of a reactor according to the present invention.

Figure 4A:
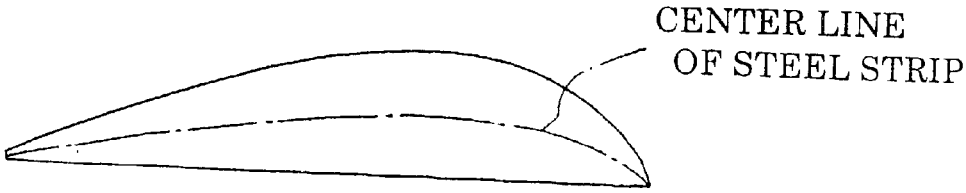
FIG. 4A through FIG. 4F show plan views of respective shapes of a soft magnetic thin strip from which the wound and laminated iron core may be formed.
Figure 4B:
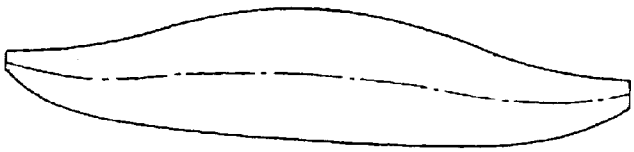
Figure 4C:
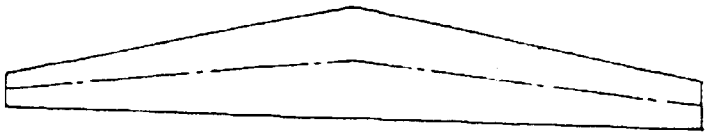
Figure 4D:
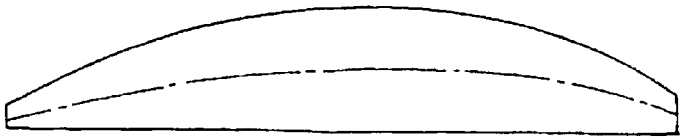
Figure 4E:
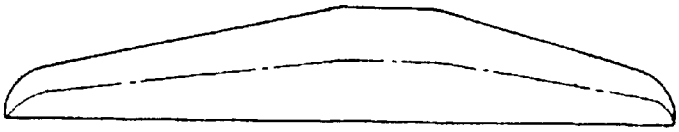
Figure 4F:
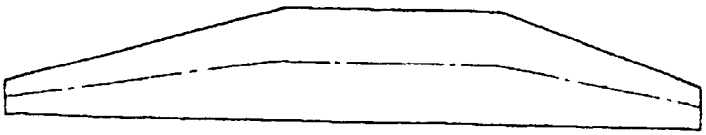

The reactor comprises a wound and laminated iron core 1 formed by winding a soft magnetic thin strip shown in FIG. 4A in a circular ring shape along the centerline in a width direction thereof, and a rectangular conductor wire coil 2 wound in an upright orientation over almost the entire periphery of the wound and laminated iron core 1, wherein the cross sectional shape of the wound and laminated iron core 1 vertical to the periphery of the ring is in a circular shape. FIG. 3 shows the plan view of the wound and laminated iron core 1 of FIG. 2 viewed from above the periphery of the circular ring.

Since the rectangular conductor wire coil 2 wound in the upright orientation is formed by winding a rectangular conductor wire 20 in an upright orientation over almost the entire periphery of the wound and laminated iron core 1 in a circular ring shape, the rectangular conductor wire 20 spreads in radial directions (i.e., in a fan shape) from the inner peripheral side of the wound and laminated iron core to the outer peripheral side thereof, as shown in FIG. 2A. In this case, the range of winding of the rectangular conductor wire coil 2 in the upright orientation in the peripheral direction of the wound and laminated iron core 1 may be almost the entire periphery of the wound and laminated iron core 1. A non-wound section may be provided, as seen in FIG. 2A. Consequently, this type of reactor can reduce the switching noise caused from the leakage of current via parasitic capacitor to one tenth or less as compared with conventional type reactors because of the state of non-touching between adjacent portions of the rectangular conductor wire 20 and because of less series capacitance therebetween. As a result, the noise abatement parts which are externally mounted to prevent switching noise can be significantly simplified.

A detailed description of the structure of the reactor is given below.

Figure 5A:
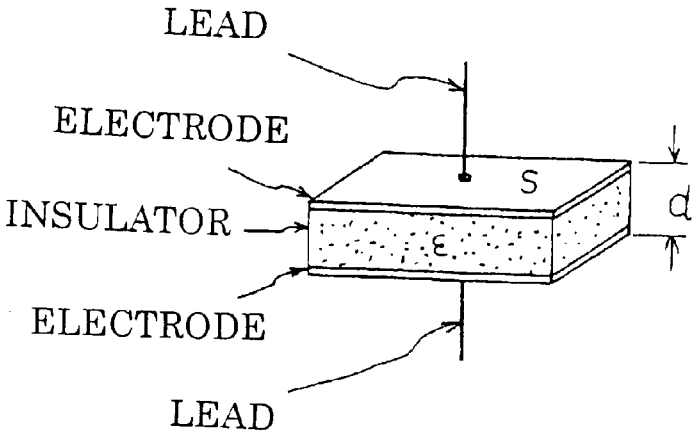
FIG. 5A and FIG. 5B illustrate parameters which determine the capacitance of a parasitic capacitor between adjacent rectangular conductor wires.

The capacitance C of a capacitor shown in FIG. 5A is determined by the electrode area S, the distance between electrodes d, and the dielectric constante $\epsilon$ of the insulation material, and is expressed by the following equation.

$$C=\epsilon S/d$$

Accordingly, if the electrode area S is fixed, the capacitance C of the capacitor is proportional to the dielectric constant $\epsilon$ of the insulation material, and inversely proportional to the distance d between electrodes, (or the thickness of the insulation material).

Figure 5B:
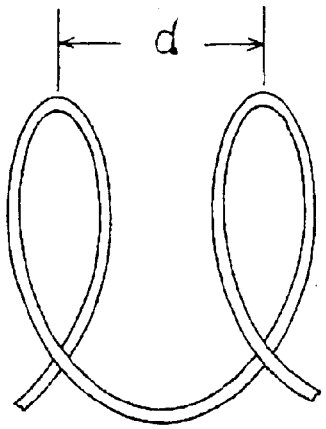

Regarding the capacitance C of a parasitic capacitor between adjacent rectangular conductor wires in a reactor shown in FIG. 5B, the side face area of the rectangular conductor wire corresponds to the electrode area S, and the distance between adjacent rectangular conductor wires corresponds to the distance d between electrodes. Thus, the capacitance C of the parasitic capacitor between adjacent rectangular conductor wires is determined by these variables and the dielectric constant $\epsilon$ using the equation given above.

Figure 6A:
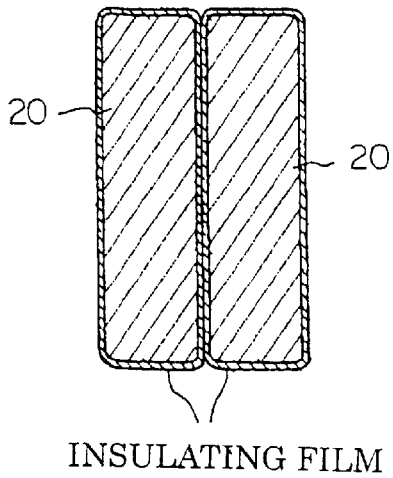
FIG. 6A and FIG. 6B show a cross section of adjacent portions of a rectangular conductor wire of a conventional reactor and a reactor according to the present invention, respectively.
Figure 6B:
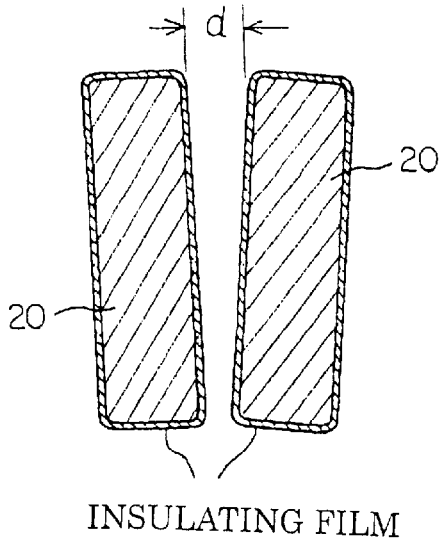
Figure 7A:
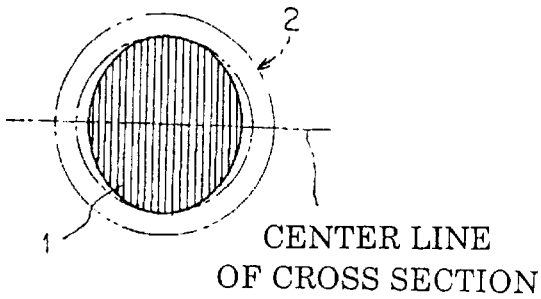
FIG. 7A through FIG. 7E show various types of cross section of wound and laminated iron cores formed from soft magnetic thin strips.
Figure 7B:
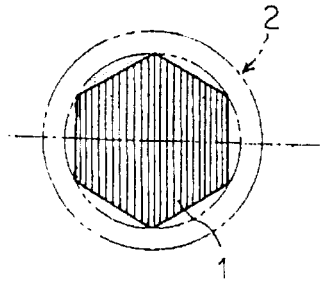
Figure 7C:
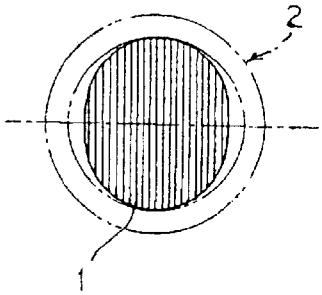
Figure 7D:
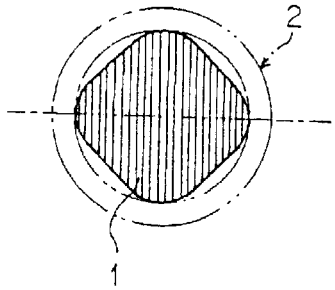
Figure 7E:
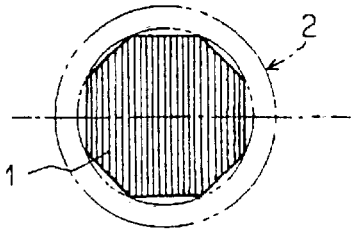

As shown in FIG. 6A, a conventional type reactor gives close contact between adjacent portions of the rectangular conductor wire 20 via an insulating film having about 0.1 mm in thickness on respective surfaces of the rectangular conductor wire. On the other hand, in the reactor according to the present invention, which is shown in FIG. 6B, since the rectangular conductor wire 20 spreads in radial direction from the inner peripheral side of the wound and laminated iron core to the outer peripheral side thereof, there exists an air layer or a resin layer for coil adhesion, as well as the insulating film having about 0.2 mm in thickness, between adjacent portions of the rectangular conductor wire 20. Consequently, the dielectric constant $\epsilon$ decreases, and the distance d between electrodes increases (to about eleven times or more than that in the conventional type), thus significantly reducing the capacitance of the parasitic capacitor between adjacent portions of the rectangular conductor wire 20 (to about one tenth). As a result, the switching noise caused from the leakage of current via the parasitic capacitor becomes about one tenth.

Furthermore, in the conventional type reactor, the coils are located in a parallel proximity arrangement to minimize the reactor size, which induces increased parallel capacitance between coils. The arrangement induces the generation of resonance current within the coil when the rectangular wave current is OFF, which worsens the switching noise characteristic. To the contrary, the reactor according to the present invention achieves a significantly large inner diameter of the coil ring as compared with the coil distance in the conventional type reactor. Thus, the parallel capacitance between coils facing to each other in the radius direction of the reactor is very small (about one tenth) as compared with the conventional type reactor. Therefore, the generation of resonance current within the coil becomes difficult when rectangular wave current is OFF. As a result, compared with the conventional type reactor, the EMI characteristic is significantly improved.

Furthermore, the reactor according to the present invention achieves a small alternating effective resistance owing to the proximity effect, so that the coil calorific loss of the reactor becomes significantly smaller than that in the conventional type reactor. The reason for this phenomenon is the following.

Resistance of a conductor wire is determined by the dielectric current resistance+skin effect+proximity effect. Generally, high frequency wave current tends to flow through skin portion of the conductor, and avoids flowing through the center portion thereof. Accordingly, it is difficult for a high frequency wave current to flow through the conductor wire. If the frequency is extremely increased, current flows through only the skin portion, and the cross sectional area of the conductor available for the flow of high frequency wave current is limited only to the skin portion. Thus, the alternating effective resistance becomes large as compared with the direct current resistance (skin effect). To reduce the alternating effective resistance owing to the skin effect, the skin area is necessarily increased. To do this, a rectangular conductor wire wound in an upright orientation or a litz wire is more preferable than a round conductor wire.

On the other hand, inductance (which is increased by magnetic flux generated from another proximity conductor) also interferes with the flow of current (proximity effect). To reduce the alternating effective resistance caused by the proximity effect, it is effective to widen the distance between rectangular conductor wires of the rectangular conductor wire coil wound in an upright orientation. As shown in FIG. 6B, the reactor according to the present invention provides a radially spreading coil winding pattern from the inner peripheral side of the wound and laminated iron core to the outer peripheral side thereof. Thus, the alternating effective resistance caused by the proximity effect can be reduced, and the coil calorific loss is reduced by 25 to 51% as compared with that of the conventional type reactor. For example, when alternating current is introduced at 20 kHz and 100 kHz to a coil formed by a rectangular conductor wire having 5 mm in width and 0.9 mm in thickness and wound to 20 mm in inner coiling diameter with 76 turns (providing 0.024 Ω of direct current resistance), respectively, the reactor according to the present invention produced an effective resistance of 0.156 Ω/20 kHz and 0.330 Ω/100 kHz, respectively, while the conventional type reactor gave 0.206 Ω/20 kHz and 0.670 Ω/20 kHz, respectively. That is, the reactor according to the present invention reduced the effective resistance by 24% and 51% for the respective frequencies.

Since the conventional type reactor comprises closely contacted adjacent portions of the rectangular conductor wire 20, as shown in FIG. 6A, the contact area between the coil and air is limited to the side faces of the rectangular conductor wire 20. Furthermore, since the coils are located in a parallel proximity arrangement, effective heat dissipation cannot be attained. To the contrary, with the reactor according to the present invention, adjacent portions of the rectangular conductor wire 20 are not in contact to each other, as shown in FIG. 6B, and the inner diameter of the coil ring is larger than the distance between coils of the conventional type reactor. Thus, the contact area between each portion of the coil and air or a resin for coil adhesion is satisfactorily secured (to about ten times or more than that of conventional type reactor), which allows effective heat release. As a result, the reactor is significantly reduced in size and weight.

As shown in FIG. 6A and FIG. 6B, an insulating film is formed on the surface of conductor such as the rectangular conductor wire 20. Since pinholes may inevitably be formed in the insulating film (at a certain probability), there is a danger of dielectric breakdown between adjacent coils caused from the pinholes. In the reactor according to the present invention, however, a gap is established between adjacent coils on almost the entire periphery thereof, and the gap is either an air layer or a resin layer for coil adhesion. Thus, there is an extremely small probability that dielectric breakdown caused from pinholes will be induced.

Since the conventional type reactor is formed by locating coils in a parallel proximity arrangement, an insulation material is required to assure the insulation dielectric strength. In the reactor according to the present invention, however, a wide distance between coils means that an insulation treatment to assure the insulation dielectric strength is not required.

Since the conventional type reactor is formed by winding rectangular conductor wire in straight cylindrical shape, leaked magnetic flux occurring from edges of the coil is large. In the reactor according to the present invention, however, the coil winds over almost the entire periphery of the ring-shaped wound and laminated iron core. Thus, the leaked magnetic flux is small, and the influence on surrounding area becomes less. In concrete terms, if the coil inner diameter is fixed, the cross sectional area of the (circular cross section) iron core of the reactor according to the present invention increases by a maximum of approximately 57% as compared with the cross sectional area of iron core having a square cross section in a reactor of the conventional type, thus reducing the density of magnetic flux, which makes it difficult to saturate the magnetic flux in the iron core, and allows the gap of the iron core to be increased. As a result, inductance is not reduced even with a large current.

When a rectangular conductor wire 20 is wound in an upright orientation, the shape of a single turn normally becomes circular. Accordingly, the cross sectional shape of the wound and laminated iron core vertical to the periphery of the ring is preferably circular, as described above, to avoid generation of a gap between the wound and laminated iron core and the rectangular conductor wire coil wound in an upright orientation.

FIG. 7 shows various types of wound and laminated iron cores 1 in cross section vertical to the peripheral direction of the ring. For the cross sections other than circular, FIG. 7A shows elliptical shape, and FIG. 7B shows a hexagonal shape. FIG. 7C shows a shape encircled by a pair of point-symmetrically positioned circular arcs with straight lines connecting respective edges of the pair of circular arcs on respective sides. FIG. 7D shows a square shape whose apexes comprise a circular arc. And FIG. 7E shows an octagonal shape. These types of cross sectional shapes are formed by winding, for example, several hundreds of turns of the respective soft magnetic thin strips shown in FIG. 4B through FIG. 4F along the centerline of the width direction thereof. In this case, except for the case of the octagonal shape, (FIG. 7E), the straight line section which forms the outer periphery of each cross section is not in parallel with the centerline. In the case of octagonal shape (FIG. 7E), two straight line sections are in parallel with the centerline.

Generally applied rectangular conductor wires have a ratio of thickness to width of around 1:5, and they are coated by a thin insulating film.

Any method for winding the rectangular conductor wire coil around the wound and laminated iron core may be applied. If the wound and laminated iron core is not divided, it is possible, for example, to feed the rectangular conductor wire using rolling mills while applying bending against the wound and laminated iron core, thus winding around the wound and laminated iron core. In the case that the wound and laminated iron core is divided into sections, it is possible to separately prepare the rectangular conductor wire coil wound in an upright orientation, and to insert the divided wound and laminated iron core 1 into the coil, and then to assemble the wound and laminated iron core.

Applicable coils winding around the wound and laminated iron core include the above-described rectangular conductor wire, a round conductor wire (i.e., a circular cross section conductor wire) coil, and a litz wire coil. The rectangular conductor wire coil wound in an upright orientation is advantageous in reducing the alternating effective resistance by the skin effect and also in terms of space efficiency.

In general, the outer face of the wound and laminated iron core is covered by an insulating coating such as resin film, or is covered with an insulating plastic cover, and then the coil is wound thereon.

Figure 8A:
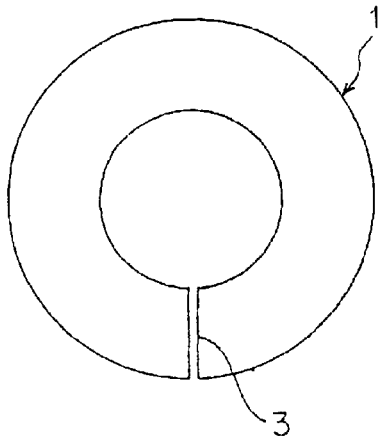
FIG. 8A through FIG. 8C show plan view of wound and laminated iron core having gaps therein.
Figure 8B:
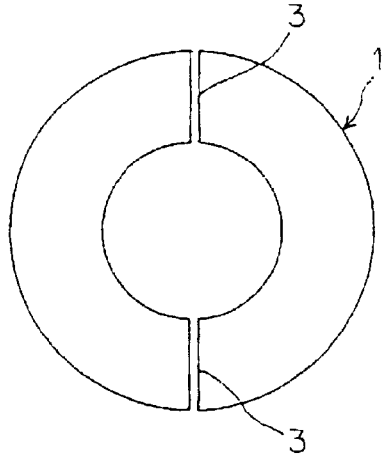
Figure 8C:
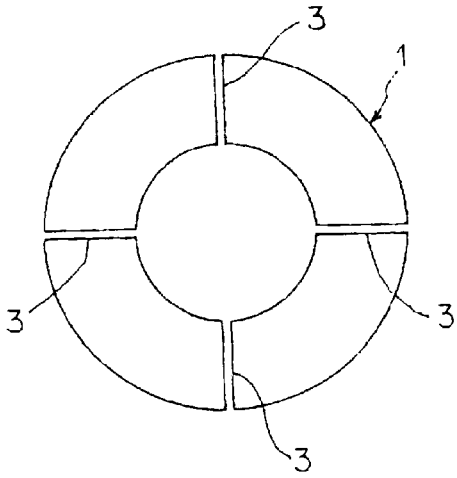

As shown in FIG. 8A through FIG. 8C, if more than one gap 3 is provided in the peripheral direction of the ring-shaped wound and laminated iron core 1, the inductance reduction at high current is prevented. FIG. 8A shows the case of a single gap, FIG. 8B shows the case of two gaps, and FIG. 8C shows the case of four gaps. An increased number of gaps prevents the reduction in inductance at higher current, thus realizing a superior direct current convolutional characteristic of inductance.

The gap 3 can be formed by cutting the wound and laminated iron core 1 by a grinder cutting method and the like. To keep the gap 3, an insulation material such as a plastic can be inserted into the gap 3.

Figure 9A:
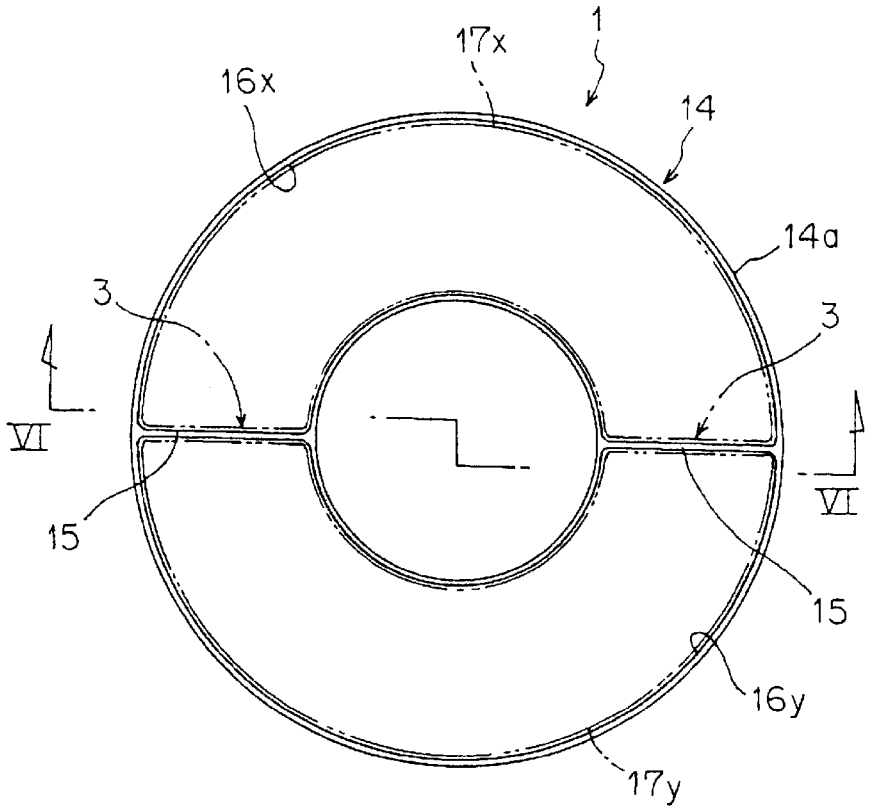
FIG. 9A and FIG. 9B show a wound and laminated iron core having gaps therein.
Figure 9B:
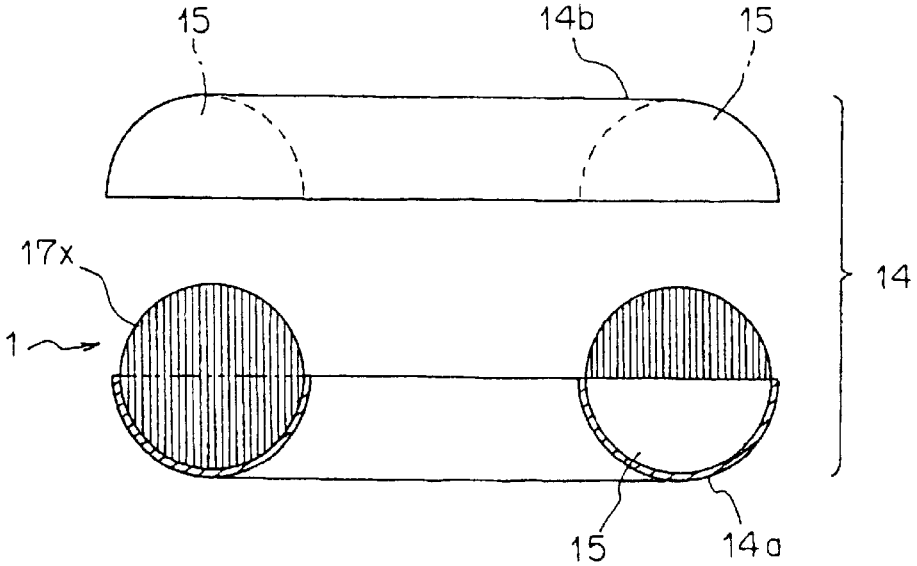

FIG. 9A and FIG. 9B show an example wherein the divided sections 17*x* and 17*y* of the wound and laminated iron core 1 are housed in a doughnut-shape plastic casing 14. FIG. 9A shows the plan view, and FIG. 9B shows a cross sectional view along line VI—VI in FIG. 9A.

The plastic casing 14 comprises a pair of casing members 14*a* and 14*b* and divided along the periphery of the doughnut-shape plastic casing 14. At two positions in the peripheral direction of each of the casing members 14*a* and 14*b*, respective separation plates 15 are located to separate housings 16*x* and 16*y* and for housing respective divided sections 17*x* and 17*y* of the wound and laminated iron core 1. The divided sections 17*x* and 17*y* of the wound and laminated iron core 1 are housed in respective housings 16*x* and 16*y*, and the casing members 14*a* and 14*b* and are connected to each other using an adhesive, a mechanical connecting means, or the like. A coil is wound around the plastic casing 14 which houses the divided sections 17*x*, 17*y* of the wound and laminated iron core 1.

When the wound and laminated iron core 1 is divided into three or more sections, a separation plate is located at each of three or more positions in the peripheral direction of each of the casing members 14*a* and 14*b*, thus forming the housings 16 corresponding to the number of divisions of the wound and laminated iron core.

Figure 10A:
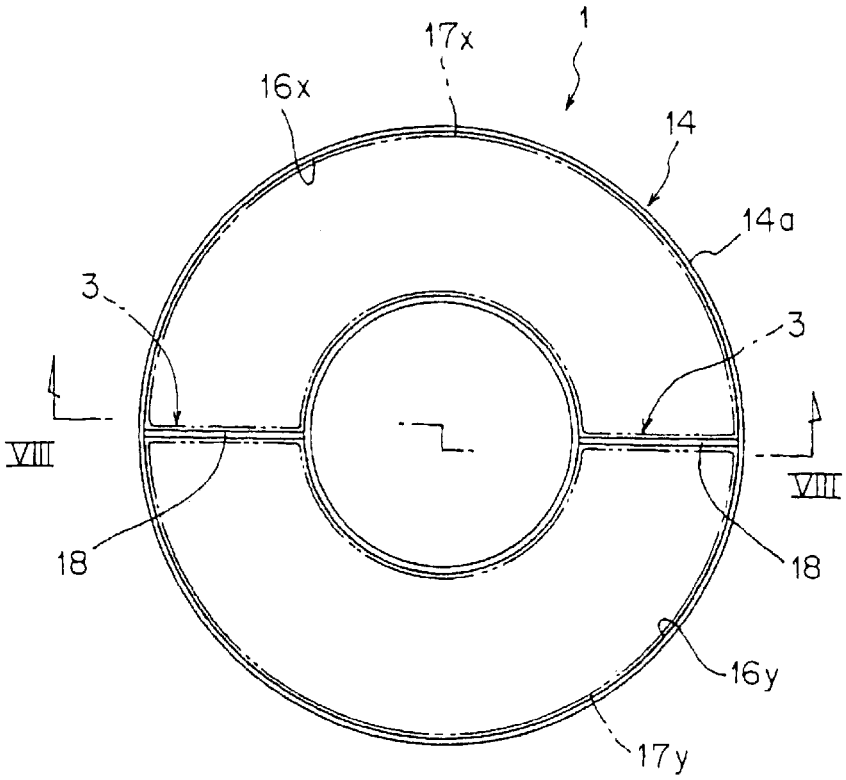
FIG. 10A and FIG. 10B show another wound and laminated iron core having gaps therein.
Figure 10B:
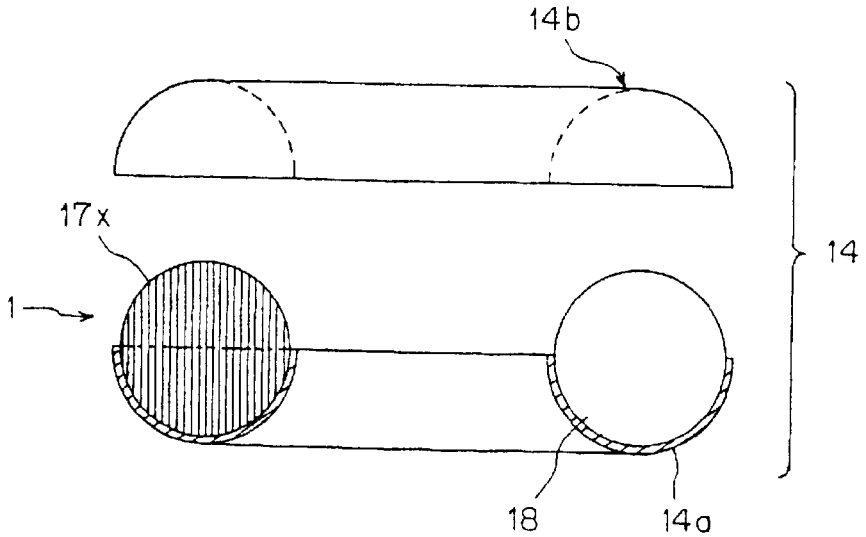

FIG. 10A and FIG. 10B show another example of a doughnut-shape plastic casing 14 which houses a pair of divided sections 17*x* and 17*y* of the wound and laminated iron core 1. FIG. 10A is the plan view, and FIG. 10B is a cross sectional view along line VIII—VIII in FIG. 10A.

The example shows a pair of divided casing members 14*a* and 14*b* along the periphery thereof. The example is the same as in the example of FIGS. 9A and 9B in view of housing the pair of divided housing sections 17*x* and 17*y* of the wound and laminated iron core 1 in respective housing sections 16*x* and 16*y*, and in that the casing members 14*a* and 14*b* are connected to each other using an adhesive, a mechanical connecting means, and the like. However, the example adopts no separation plate inside of the casing members 14*a* and 14*b*, and forms a gap 3 between the divided sections 17*x* and 17*y* of the wound and laminated iron core by inserting an insulation material 18 such as a plastic.

Figure 11:
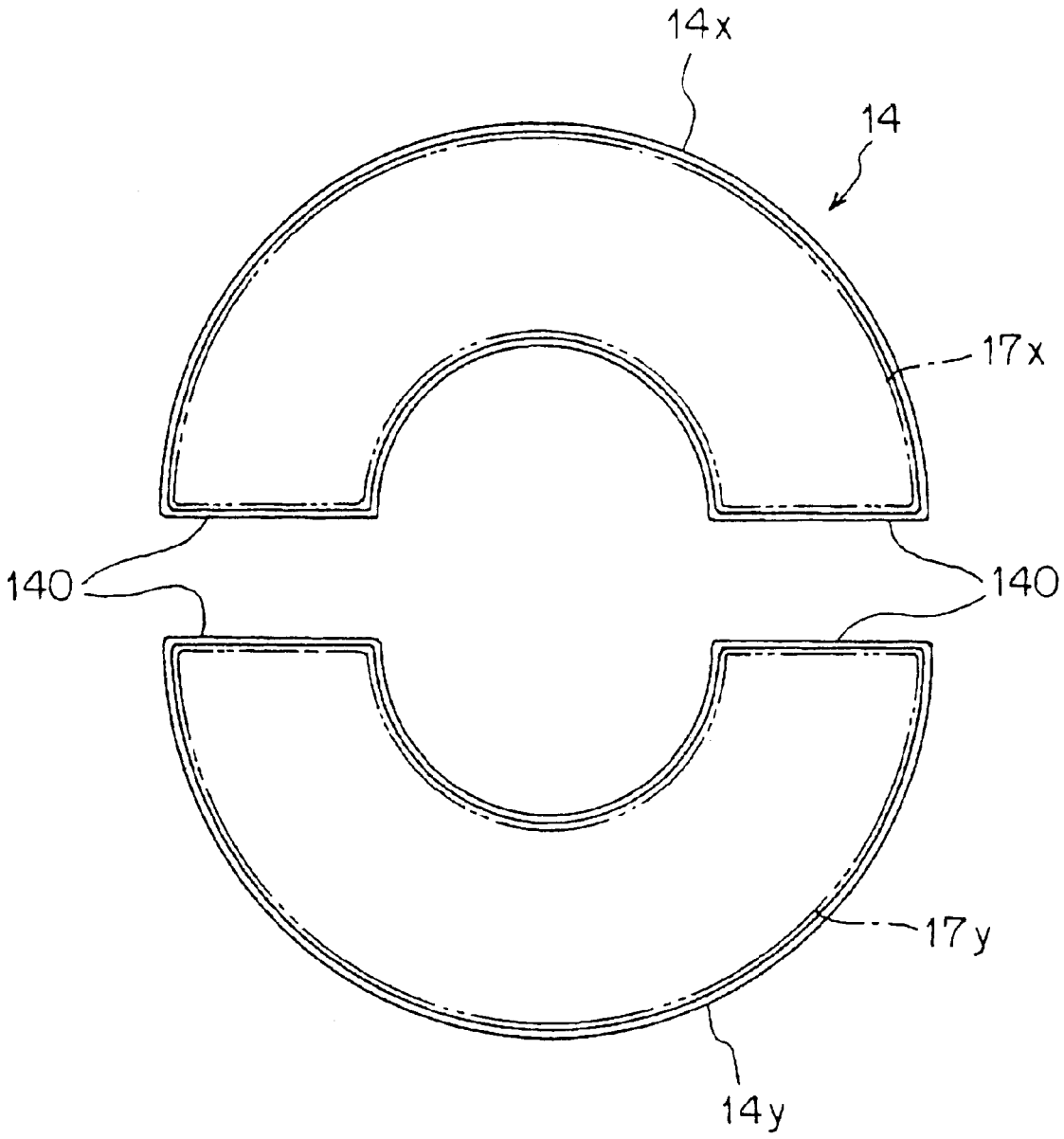
FIG. 11 shows plan view of another wound and laminated iron core having gaps therein.

FIG. 11 shows an example where the plastics casing 14 comprises two casing members 14*x* and 14*y* which house respective divided sections 17*x* and 17*y* of the wound and laminated iron core 1, and where the ring-shaped plastic casing 14 is formed by connecting these casing members 14*x* and 14*y* to each other. In this case, the gap in the wound and laminated iron core is formed by the casing edges 140 at the joint of the casing members 14*x* and 14*y*.

The casing members 14*x* and 14*y* are prepared by dividing the half doughnut-shape casing into two pieces along the periphery thereof. The casing members 14*x* and 14*y* are connected to each other using an adhesive, a mechanical means, or the like to form a ring-shaped plastic casing 14.

When the wound and laminated iron core is divided into three or more pieces, the ring-shaped plastic casing 14 is prepared by preparing a number of casing members equal to the number of divisions of the wound and laminated iron core, and by connecting these casing members to each other.

Applicable soft magnetic thin strips include an oriented or non-oriented silicon steel sheet containing less than 4 mass % Si, a high silicon steel sheet containing 4 to 7 mass % Si, and an amorphous steel sheet. Further reduced noise and loss are attained by using a silicon steel sheet containing an average of 4.0 to 7.0 mass % Si in a thickness direction thereof, preferably 6.2 to 6.9 mass %, and more preferably 6.65 mass %, or by using a silicon steel sheet containing 6.0 to 7.0 mass % Si in a surface layer thereof which is higher than the Si content in the center portion in the thickness direction by 0.5 mass % or more, wherein the distribution of Si content in the thickness direction is nearly symmetrical to the center of the thickness. Since this type of silicon steel sheet gives less magnetostriction and has very weak magnetic sensitivity against physical strain, the necessity of stress relief annealing becomes less. Furthermore, low Si content at the central portion of the sheet in the thickness direction enables brittleness to be avoided in the surface section of steel sheet where the Si content is high, which is advantageous in forming the sheet into the shapes shown in FIGS. 4A through 4F.

Normally, this kind of steel sheet is manufactured from a steel sheet containing small amount of Si, less than 4 mass %, by siliconizing the steel sheet to penetrate Si into the surface layer thereof, then by diffusing the Si from the surface layer in the sheet thickness direction. Regarding the silicon steel sheet containing an average of 4.0 to 4.0 mass % Si in the thickness direction, the Si concentration may have constant distribution in the sheet thickness direction even if the Si content is nearly uniform in the sheet thickness direction.

The thickness of silicon steel sheet is not specifically limited. However, it is preferable that the sheet thickness be around 0.02 to 0.1 mm for high frequency waves.

The wound and laminated iron core of the reactor according to the present invention is formed by winding a soft magnetic thin strip in a circular ring shape or elliptical ring shape. Consequently, strain is hard to be induced when they are wound, and thus the iron core can be applied without providing strain relief annealing.

In a reactor having the above-described structure, particularly a reactor having a gap therein, electromagnetic force is induced when current is introduced to the coil, which induces the concentration of coiled wires to a portion where no gap exists on the wound and laminated iron core, which then results in movement of coiled wires to eliminate coiled wires from the gap portion on the wound and laminated iron core. When the current varies, the movement of the coiled wires also varies, and the vibration on movement generates noise. To suppress the generation of noise accompanied by the coil vibration caused from this kind of electromagnetic force, it is effective to adhere and fix the coil to the wound and laminated iron core using a resin.

On adhering and fixing the coil to the wound and laminated iron core using a resin, if only the resin is filled between the adjacent coils at least in a part of the coil periphery, the movement of adjacent coil wires is surely prevented to suppress noise generation.

It is more preferable that the resin adhesion layer is formed on almost the entire outer periphery of the ring of the wound and laminated iron core, and that at least a part of the periphery of the coil is buried in the resin adhesion layer.

In this case, the resin adhesion layer may be formed over the whole surface of the wound and laminated iron core, and the whole of the coil may be buried in the resin adhesion layer. To satisfactorily achieve heat dissipation from the coil, it is preferable that the resin adhesion layer is formed on only about half the cross section of the wound and laminated iron core, and that about half of the coil periphery is buried in the resin adhesion layer, while the other approximately half portion thereof is exposed to air.

This type of reactor is readily formed by placing the wound and laminated iron core wound with coil therearound in a container, and by filling a resin liquid in the container to harden and adhere the wound and laminated iron core to the container.

Figure 12:
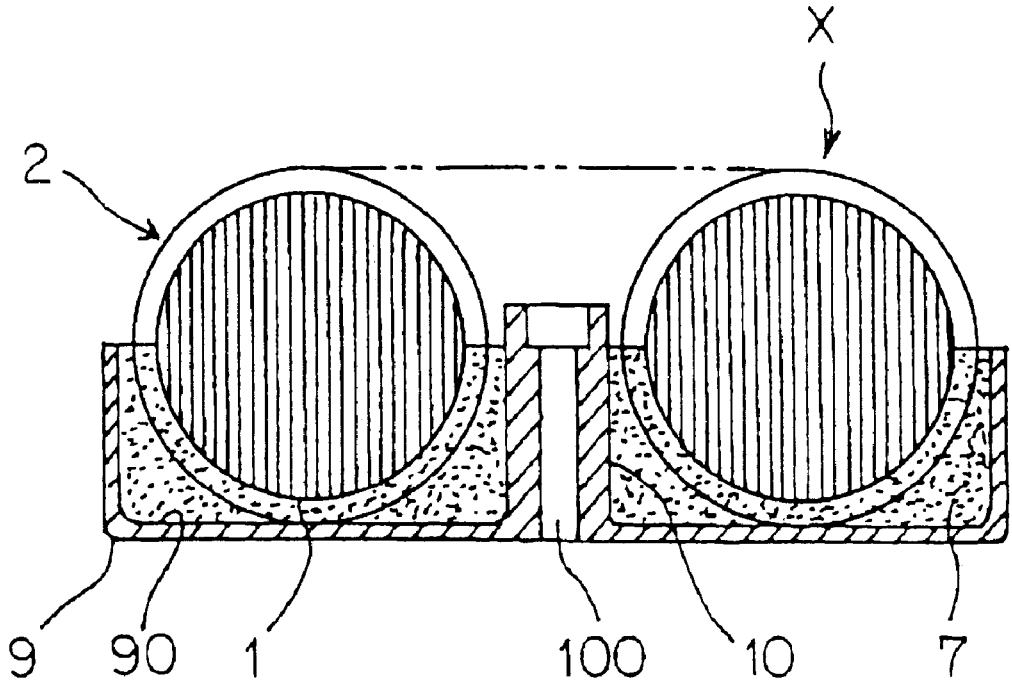
FIG. 12 shows a cross sectional view of a reactor having a wound and laminated iron core which is part-buried in a resin adhesive layer formed in a container.

FIG. 12 shows a cross sectional view of a reactor which has a wound and laminated iron core adhered and fixed to a container using a resin.

The reactor body X comprises a wound and laminated iron core 1, and a coil 2 housed in an annular housing 90, of a shallow container 9 having an open top. The upper half of the reactor body X is exposed from the container 9. By filling a resin in the container 9, a resin adhesion layer 7 is formed in a portion corresponding to about half of the cross section of the wound and laminated iron core 1. About half of the periphery of the coil 2 is buried in the resin adhesion layer 7. The resin adhesion layer 7 surely prevents the movement of adjacent coils 2. And since the upper half of the reactor body X is protruded from the container 9 to be exposed to air, heat dissipation from the coil 2 is adequately achieved.

The end leads of the coil 2 may be withdrawn in a lateral direction to the coil through, for example, a notch groove formed at top edge of the container 9, or may be withdrawn upright from the container 9 without forming such a notch groove.

The container 9 also plays the role of fixing the body X, and is designed to be fixed to various types of equipment. To do this, at the center portion of the container 9, a mounting section 10 is provided to mount a fixing bolt or a fixing screw. The mounting section 10 is provided with a mounting hole 100. The container 9 which integrally fixes the reactor body X using a resin is then mounted to any of various kinds of equipment using a fixing bolt or a fixing screw attached to the mounting hole 100.

The depth of the container 9 which houses the reactor body X may be arbitrarily selected, and, depending on the situation, the depth may be sufficient to hide most of or all of the reactor body X. A satisfactory depth of the container 9 is a depth which enables the coil 2 to be adhered and fixed to the wound and laminated iron core 1 using the resin adhesion layer 7 formed inside the container 9, and to prevent the movement of adjacent coil wires. An excessively deep container 9 may hinder the air flow against the coil 2. It is therefore preferable that the depth of the container 9 is around 20 to 60% of the height of reactor body X (i.e., the height along the center axis of the ring-shaped reactor), and more preferably around 50% so as to form the resin adhesion layer 7 only in the region corresponding to about half (i.e., the lower half) of the cross section of the wound and laminated iron core, which is shown in FIG. 12.

The inner face of the container 9 may be formed to have a circular arc cross section responding to the outer shape of the coil 2 of the reactor body X. The material of container 9 may be arbitrarily selected. Normally, the container 9 is made of resin or the like.

On filling the resin in the container 9, if the resin also covers the upper half portion of the reactor body X exposed from the container 9 to form a thin film (coating by a thin film of resin layer), the upper portion of the coil 2 is also adhered and fixed to the wound and laminated iron core 1, which assures more firm fixation of the coil 2. The thin film resin layer that covers the upper half of the reactor body X may be, for example, formed in advance by applying a thin resin coating over the whole area of the reactor body X before housing the reactor body X in the container 9.

Figure 13A:
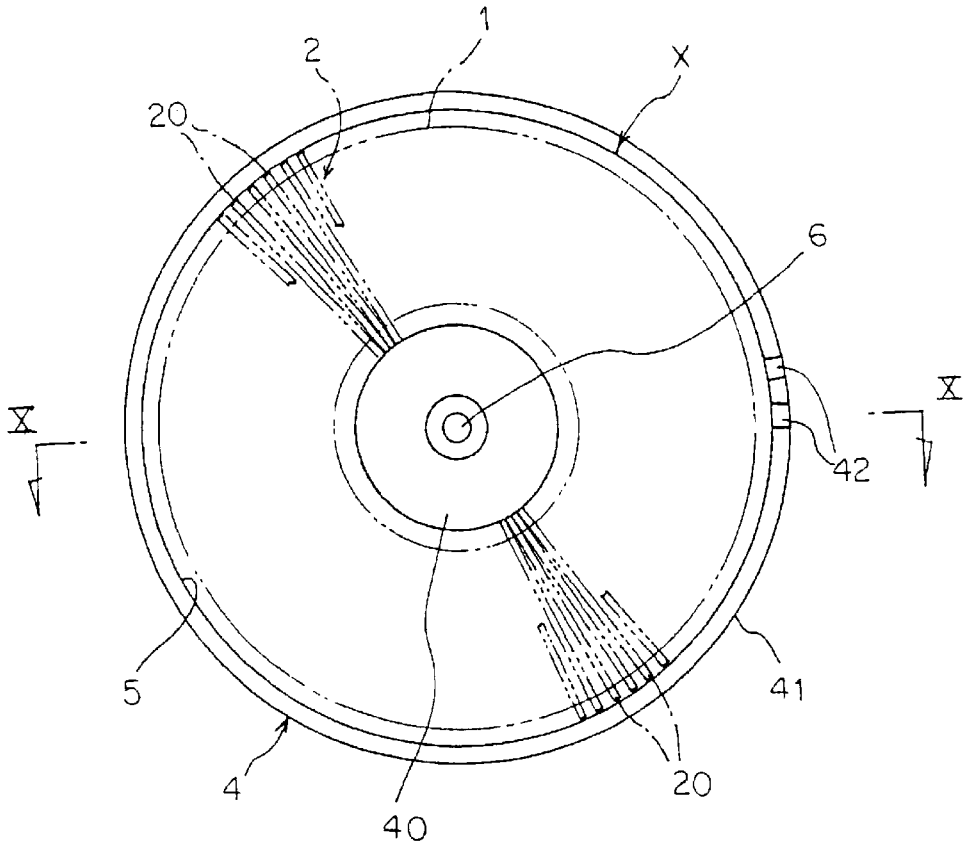
FIG. 13A and FIG. 13B show another example of reactor according to the present invention.
Figure 13B:
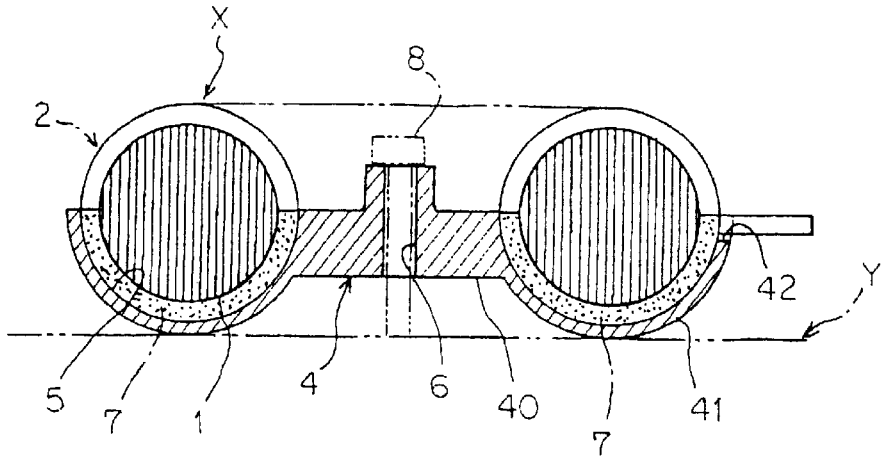

FIG. 13A and FIG. 13B (which is across sectional view along line X—X in FIG. 13A) show another example of a reactor, in which the wound and laminated iron core is adhered and fixed using a resin.

The circular ring-shaped wound and laminated iron core 1 and the rectangular conductor wire coil 2 wound in an upright orientation, which form the reactor body X, are fixed by the resin adhesion layer 7. The reactor body X is integrated with the fixer 4.

The fixer 4 is a member in a dish-shape, comprising a mounting section 40 having a mounting hole 6 for mounting to any of various kinds of equipment using a fixing bolt or a fixing screw, and a housing 41 of the reactor body X, which is located outside of the mounting section 40. The housing 41 has an annular concavity 5 to house the lower half of the circular ring-shaped reactor body X. The depth of the concavity 5 is required to be deep enough to fill the resin to fix the reactor body X, which depth may be 20 to 50% of the height of the reactor body X, and preferably around 50%.

In the reactor, the end leads 21 are withdrawn in a lateral direction to the reactor through respective notch grooves 42 formed at an upper edge of the housing 41. However, the direction of withdrawing the end leads 21 is arbitrary, and upright withdrawal may be applied.

With this type of reactor, the coil 2, the wound and laminated iron core 1, and the fixer 4 are integrally adhered and fixed to each other via the resin adhesion layer 7. Thus, vibration noise is effectively suppressed. On filling the resin in the concavity 5, if the resin also coats the upper portion of the reactor body X exposed from the concavity 5 in a thin resin film, this portion also adheres the coil 2 with the wound and laminated iron core 1, which further effectively prevents vibration noise.

The thin film resin layer that coats the upper half of the reactor body X exposed from the concavity 5 may be prepared before mounting the reactor body X to the fixer 4 by, for example, applying thin resin coating to the whole surface of the reactor body X.

When the fixer 4 has a center mounting hole 6, a single fixing bolt or fixing screw 8 allows ready attachment to any of various kinds of equipment Y.

Figure 14A:
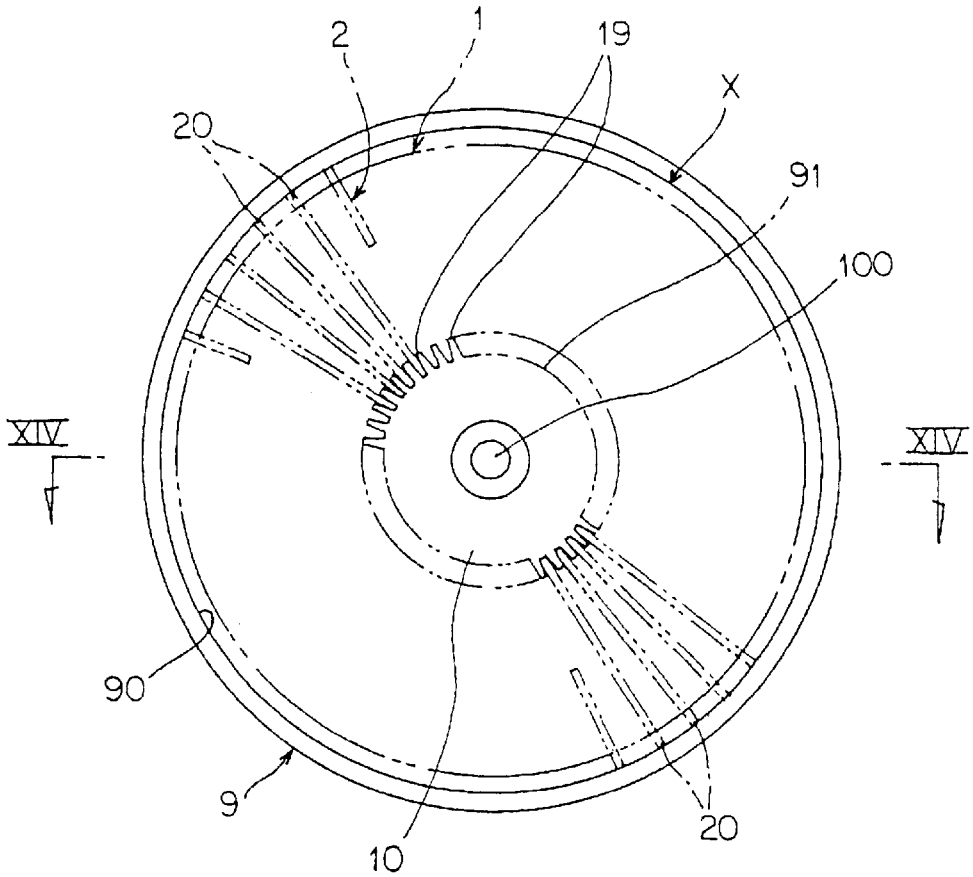
FIG. 14A and FIG. 14B show another example of reactor according to the present invention.
Figure 14B:
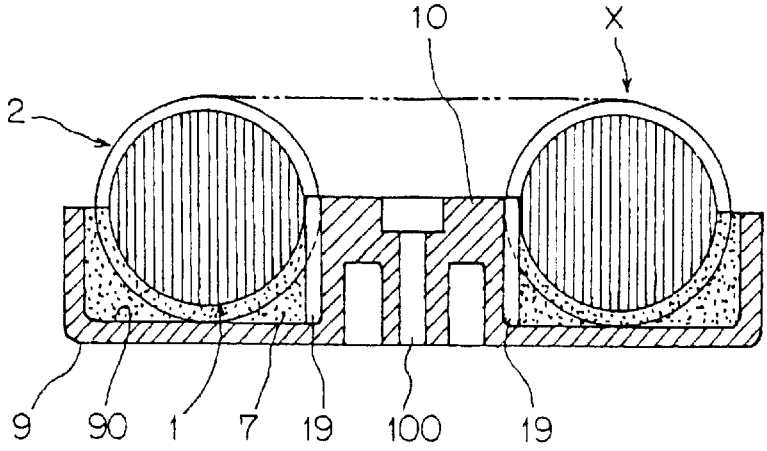
Figure 15:
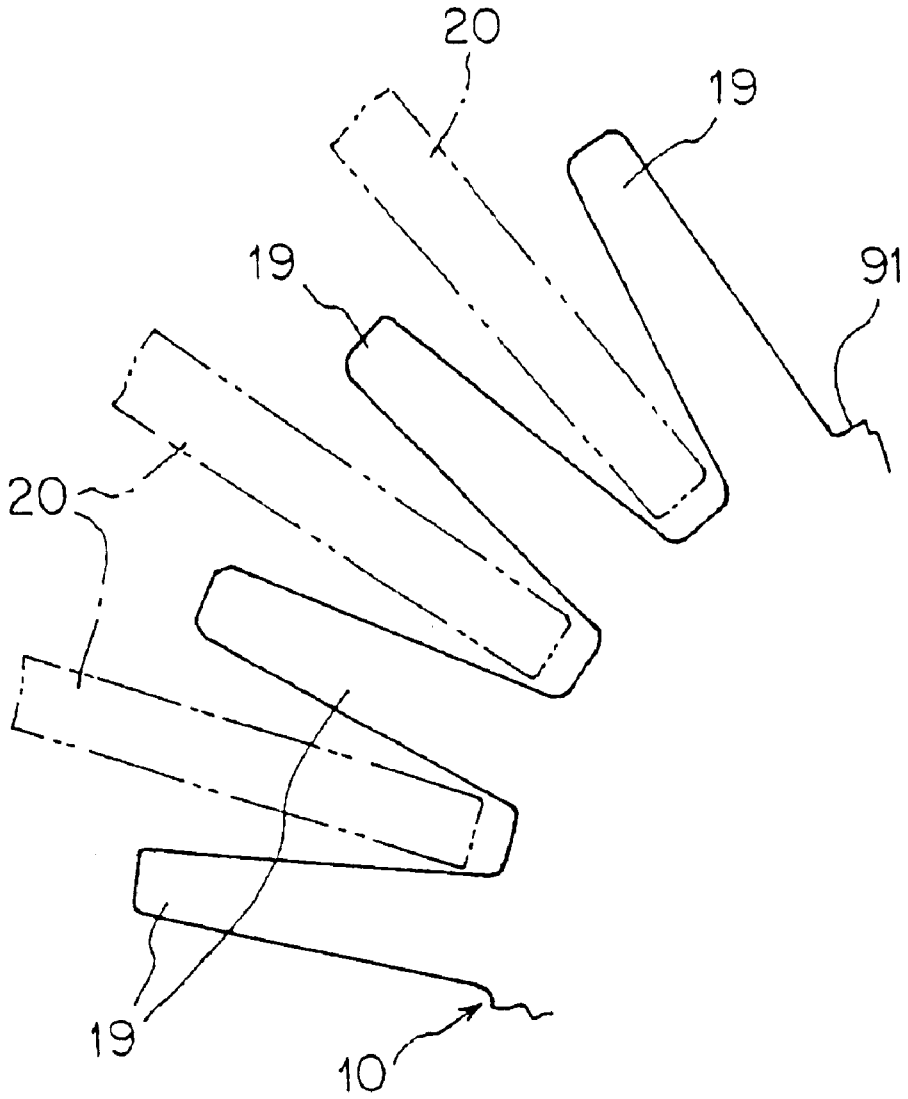
FIG. 15 illustrates protrusions formed on the inner wall of container in FIG. 14.

FIG. 14A, FIG. 14B, and FIG. 15 show a further example of a reactor according to the present invention, particularly of the reactor using a container. FIG. 14A shows a plan view, FIG. 14B shows a cross sectional view along line XIV—XIV in FIG. 14A, and FIG. 15 shows, protrusions formed on the inner wall surface of the container.

The example is a reactor having a separator function which insulates adjacent coil wires 20 in the container, which allows rectangular conductor wires having no insulation film to be used.

The container 9 is a shallow container having an open top, similar to the one shown in FIG. 12, and has an annular housing 90 which houses the reactor body X therein. On the inner wall surface 91 (or the outer periphery wall of the mounting section 10) of the annular housing 90, a plurality of protrusions 19 are formed in the peripheral direction at a specified spacing. Each of the protrusions 19 is inserted between adjacent coil wires 20 to insulate adjacent portions of the coil wire 20 from each other. As a result, even if the coil 2 adopts a conductor wire having no insulation coating, no problem occurs. Compared with the coil formed by conductor wire with insulation coating, the coil formed by conductor wire without insulation coating is markedly inexpensive, thus significantly reducing the reactor cost.

The above-described reactors use a magnetic core having a wound and laminated iron core prepared by winding a soft magnetic thin strip in a circular ring shape or in an elliptical ring shape. However, a reactor giving further low noise and loss and which is also easy to manufacture may also be prepared by using a block magnetic core such as ferritic core (sintered magnetic core) and dust core and by adhering the coil to the magnetic core using a resin.

Also when this kind of block magnetic core is applied, the formation of a cross section of the magnetic core vertical to the ring periphery, the kinds of the coils, and the method for adhering by resin are similar to those in the above-described wound and laminated iron core.

The reactor having a wound and laminated iron core according to the present invention also has the following advantages as compared with the conventional type reactors.

i) There is no need of structural members to connect and fix a plurality of iron cores to each other.

ii) There is no need of gap tightening members.

iii) Since there is no structure of mutual connection to fix the iron cores, vibration noise and resonance noise of the iron core caused from electromagnetic vibration at high frequency waves are not generated.

iv) Since the iron core is a wound iron core in a circular shape or elliptical shape, the iron core is manufactured in a short time by applying high speed and continuous coiling of a soft magnetic thin strip in a circular or elliptical ring shape, and the number of manufacturing steps is drastically reduced.

v) On discarding the reactor, the disassembly work is easy and the sorting and reuse of components are possible because the materials to be disassembled are only the iron core, the insulation material of the iron core, and copper wire.

vi) Small size and light weight allow for the reactor to be attached to a printed circuit board by direct soldering the coil end leads thereto.

The reactor according to the present invention can be applied in various kinds of power source equipment. In particular, the reactor according to the present invention is suitable for low noise and low loss inductance elements which are used in a main circuit to remove a harmonic wave current by introducing a specified frequency current and to convert into a dominant wave current at50/60 Hz. For example, the reactor according to the present invention is suitable for the inductance elements of: an inverter circuit mounted to a micro-gas turbine, a fuel cell power generator, a solar-electric power generator, a wind power generator, an air conditioner, a refrigerator, a no-break power unit, a booster converter circuit, and an EMI countermeasure circuit.

EXAMPLE 1

Figure 1A:
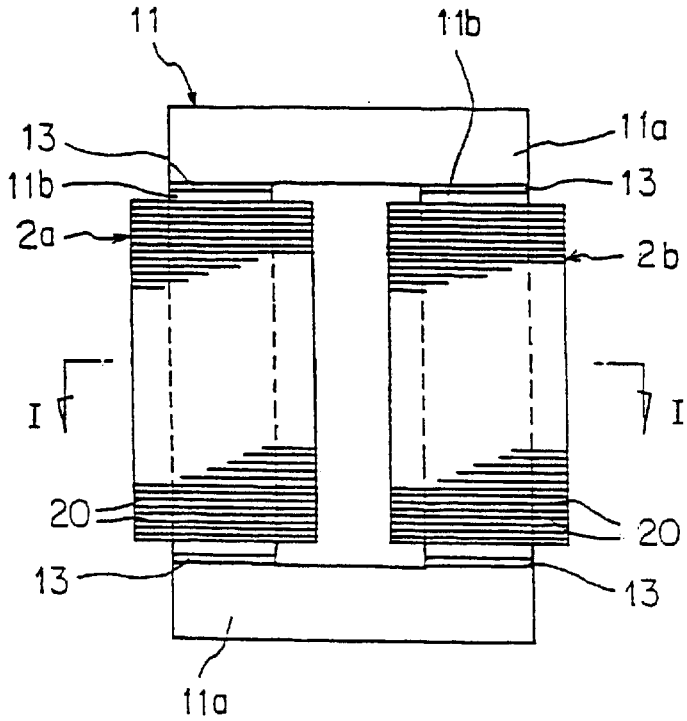
FIG. 1A (PRIOR ART)
FIG. 1A and FIG. 1B illustrate a conventional reactor.
Figure 1B:
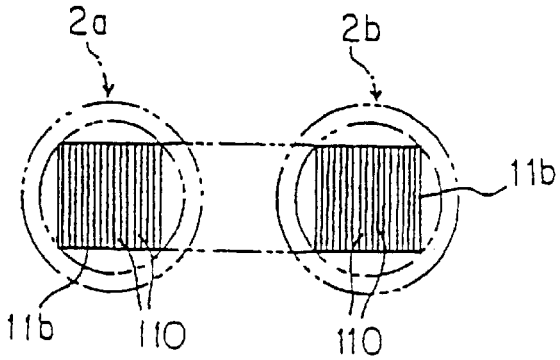
FIG. 1B (PRIOR ART)

A reactor according to the present invention, having the structure shown in FIG. 2 and FIG. 3, and a conventional type reactor shown in FIG. 1 were separately prepared. For each of the reactors, the direct current convolutional characteristic of inductance was tested.

The reactor according to the present invention comprised a wound and laminated iron core formed by winding a soft magnetic thin strip in a circular ring shape, and a rectangular conductor wire wound in an upright orientation around the wound and laminated iron core over almost the entire periphery thereof. The wound and laminated iron core had a circular cross section vertical to the periphery of the ring, and a pair of point-symmetrically positioned gaps of 2.25 mm.

The conventional type reactor comprised a laminated iron core having a square cross section, and a pair of rectangular conductor wires wound in an upright orientation around the core sections facing each other on the laminated iron core. Four gaps, each having 1.13 mm in space, were located in point-symmetrical positions.

The coil of each reactor was made of a rectangular conductor wire having 5 mm in width and 0.9 mm in thickness, with 20 mm in inner coiling diameter and 76 turns.

Figure 16:
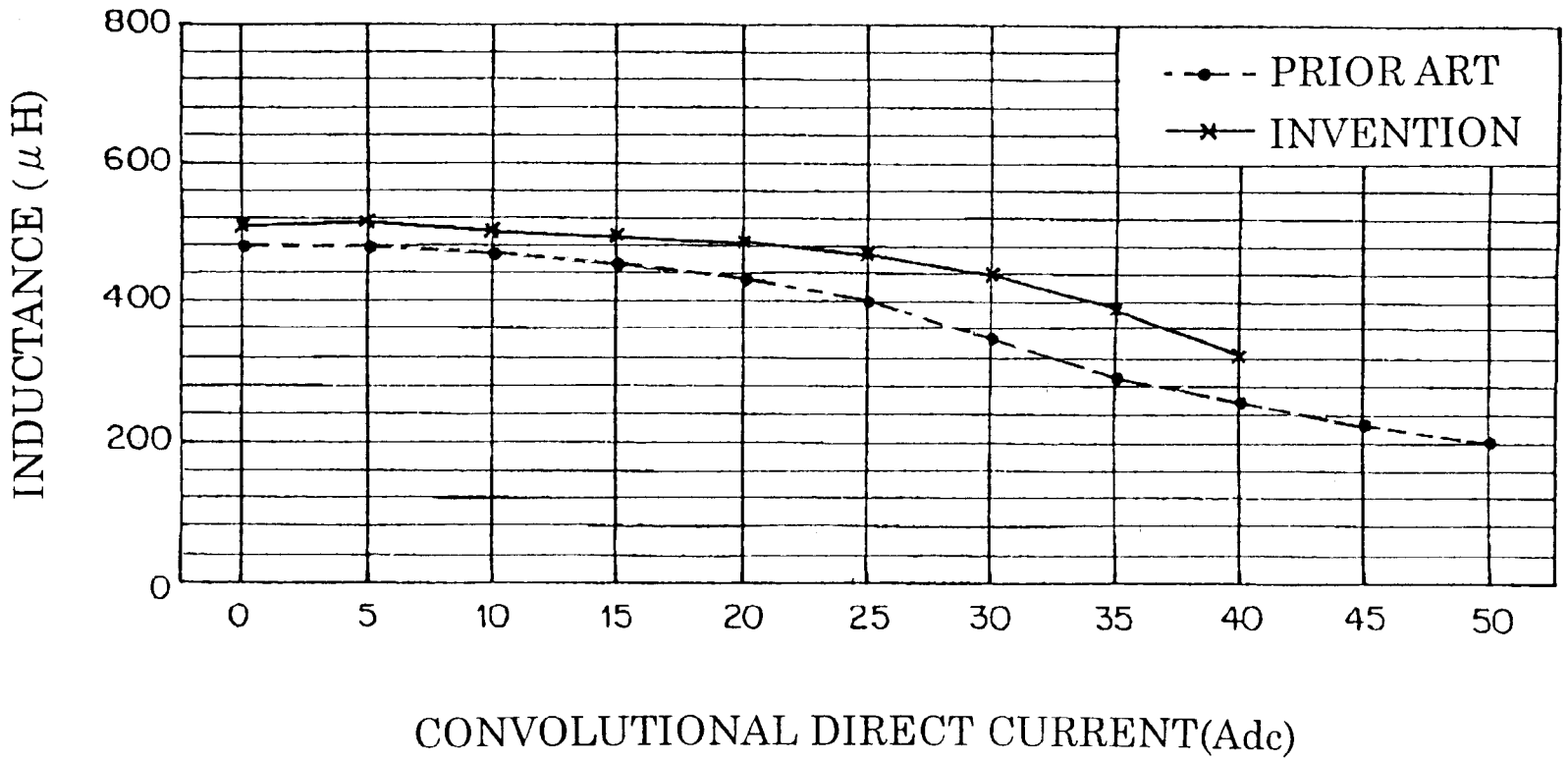
FIG. 16 is a graph showing a direct current convolutional characteristic of inductance of a reactor.

FIG. 16 shows the direct current convolutional characteristic of inductance for the reactors.

For example, at 30 A of load current, the inductance of the reactor according to the present invention was 440 $\mu$H/30 A, which is larger than the 320 $\mu$H/30 A inductance of the conventional type reactor.

EXAMPLE 2

A reactor according to the present invention having a similar structure with that in Example 1 was prepared using a rectangular conductor wire of 4 mm in width and 0.68 mm in thickness, with 20 mm in inner coiling diameter and 76 turns.

And a conventional type reactor having a similar structure with that in Example 1 was prepared using a rectangular conductor wire of 5 mm in width and 0.9 mm in thickness, with 20 mm in inner coiling diameter and 76 turns.

Figure 17:
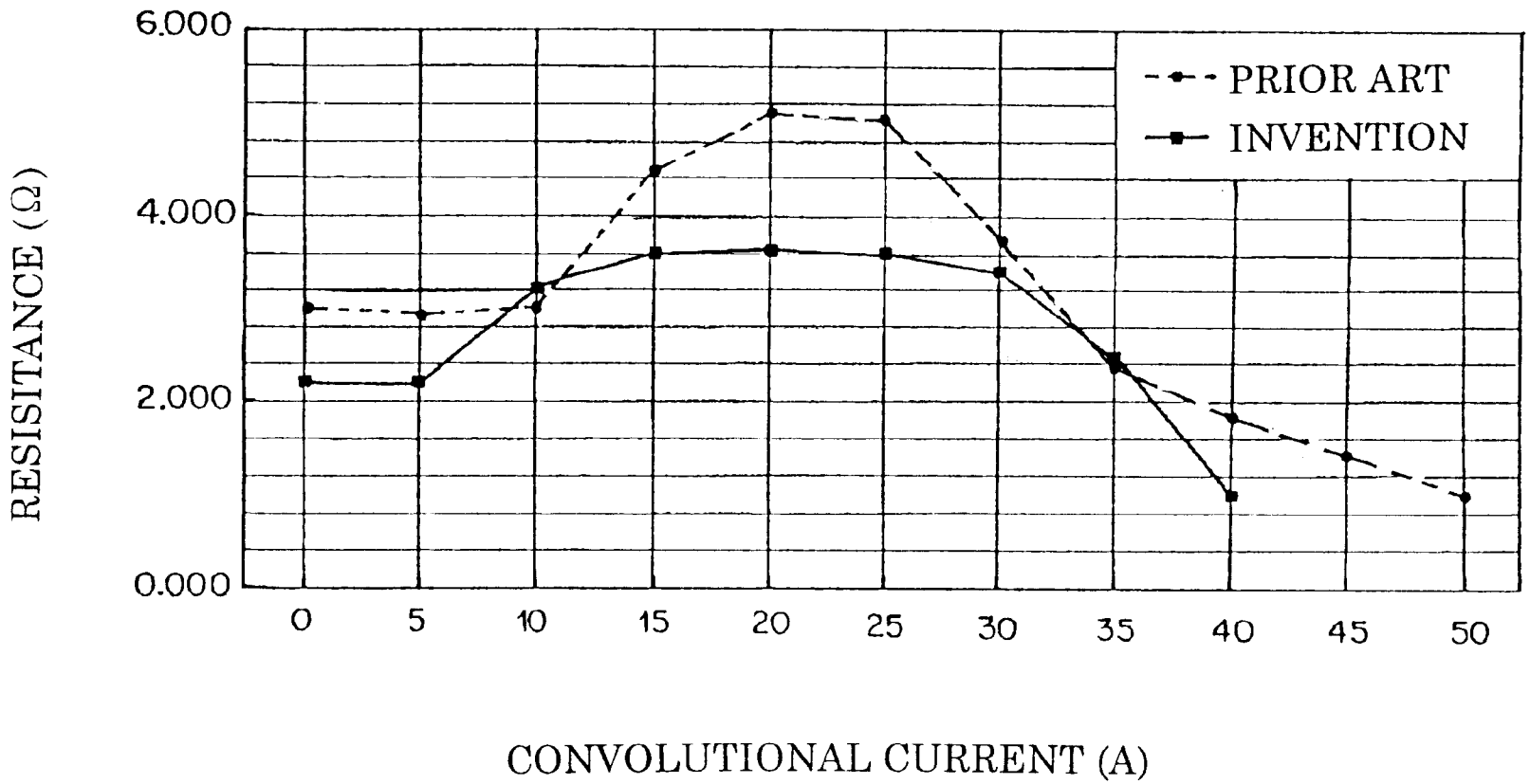
FIG. 17 is a graph showing an alternating effective resistance characteristic of a reactor.

FIG. 17 shows the alternating effective resistance characteristic of the reactors.

For example, at 20 A of load current, the alternating effective resistance of the reactor according to the present invention was 3.6 Ω/20 A, which is significantly smaller than the 5.1 Ω/20 A of the conventional type reactor, with less coil cross sectional area in the reactor of the present invention. Therefore, the reactor according to the present invention achieves size reduction and weight reduction.

What is claimed is:

1. A low noise and low loss reactor comprising:

a wound and laminated iron core formed by winding a soft magnetic thin strip into a circular ring shape or ellipticall ring shape; and a rectangular conductor wire wound in an upright orientation around almost an entire outer periphery of the wound and laminated iron core;

wherein a cross sectional shape of the wound and laminated iron core vertical to a peripheral direction of the ring shape is any one of: (i) a circular shape, (ii) an elliptical shape, (iii) a substantially regular polygon of at least 6 sides, (iv) a shape encircled by a pair of point-symmetrically positioned circular arcs or elliptical arcs with a nearly straight line connecting respective edges of the pair of circular arcs or elliptical arcs on both sides of the pair of circular arcs or elliptical arcs, and (v) a shape of a substantially regular polygon of at least 4 sides whose apexes comprise a circular arc or an elliptical arc.

2. The low noise and low loss reactor of claim 1, wherein the wound and laminated iron core has at least one gap therein in the peripheral direction of the ring shape.

3. The low noise and low loss reactor of claim 1, wherein the normal and laminated iron core is divided into a plurality of sections in the peripheral direction of the ring shape and a plastic casing is provided which is divided into a plurality of casings that house respective ones of the divided sections, and wherein a separation plate is inserted between each of the divided sections.

4. The low noise and low loss reactor of claim 1, wherein the normal and laminated iron core is divided into a plurality of sections in the peripheral direction of the ring shape and a plastic casing is provided which comprises a plurality of casings that house respective ones of the divided sections, and wherein respective edges of the casings separate each of the divided sections.

5. The low noise and low loss reactor of claim 1, wherein the soft magnetic thin strip comprises a silicon steel sheet containing 6.0 to 4.0 mass % Si in a surface layer thereof, which is higher than a Si content in a center portion in a thickness direction thereof by at least 0.5 mass %, and wherein a distribution of Si content in the thickness direction is substantially symmetrical with respect to the center portion in the thickness direction.

6. The low noise and low loss reactor of claim 2, wherein the soft magnetic thin strip comprises a silicon steel sheet containing 6.0 to 7.0 mass % Si in a surface layer thereof, which is higher than a Si content in a center portion in a thickness direction thereof by at least 0.5 mass %, and wherein a distribution of Si content in the thickness direction is substantially symmetrical with respect to the center portion in the thickness direction.

7. The low noise and low loss reactor of claim 1, wherein the rectangular conductor wire is adhered and fixed by a resin to the wound and laminated iron core.

8. The low noise and low loss reactor of claim 5, wherein the rectangular conductor wire is adhered and fixed by a resin to the wound and laminated iron core.

9. The low noise and low loss reactor of claim 5, wherein the rectangular conductor wire is adhered and fixed by a resin to the wound and laminated iron core.

10. The low noise and low loss reactor of claim 7, wherein the wound and laminated iron core around which the rectangular conductor wire is wound is housed in a container, and the wound and laminated iron core is adhered and fixed to the container by a resin filled in the container.

11. The low noise and low loss reactor of claim 8, wherein the wound and laminated iron core around which the rectangular conductor wire is wound is housed in a container, and the wound and laminated iron core is adhered and fixed to the container by a resin filled in the container.

12. The low noise and low loss reactor of claim 9, wherein the wound and laminated iron core around which the rectangular conductor wire is wound is housed in a container, and the wound and laminated iron core is adhered and fixed to the container by a resin filled in the container.

13. A low noise and low loss reactor comprising:

a magnetic core formed in a circular ring shape or elliptical ring shape;

a rectangular conductor wire wound in an upright orientation around almost an entire outer periphery of the magnetic core; and a container which comprises an annular housing having an open top, and which holds the magnetic core around which the coil is wound, said magnetic core around which the coil is wound being adhered and fixed to the container by a resin filled in the annular housing;

wherein a cross sectional shape of the magnetic core vertical to a peripheral direction of the ring shape is any one of: (i) a circular shape, (ii) an elliptical shape, (iii) a substantially regular polygon of at least 6 sides, (iv) a shape encircled by a pair of point-symmetrically positioned circular arcs or elliptical arcs with a nearly straight line connecting respective edges of the pair of circular arcs or elliptical arcs on both sides of the pair of circular arcs or elliptical arcs, and (v) a shape of a substantially regular polygon of at least 4 sides whose apexes comprise a circular arc or an elliptical arc.

14. The low noise and low loss reactor of claim 13, wherein a portion of the magnetic core around which the rectangular conductor wire is wound which is exposed above the resin filled in the annular housing is coated with a thin resin film.

15. The low noise and low loss reactor of claim 13, wherein the rectangular conductor wire comprises a conductor wire having no insulator coating, and protrusions are formed along an inner wall on an inside periphery of the annular housing at a specified spacing, said protrusions being inserted between wound wires on respective adjacent portions of the rectangular conductor wire to assure insulation between the respective adjacent portions of the rectangular conductor wire.

16. The low noise and low loss reactor of claim 13, wherein the magnetic core around which the rectangular conductor wire is wound comprises a wound and laminated iron.

17. The low noise and low loss reactor of claim 14, wherein the magnetic core around which the rectangular conductor wire is wound comprises a wound and laminated iron.

18. The low noise and low loss reactor of claim 15, wherein the magnetic core around which the rectangular conductor wire is wound comprises a wound and laminated iron.

* * * * *